US005885104A

United States Patent [19]

Foster et al.

[11] Patent Number: 5,885,104

[45] Date of Patent: Mar. 23, 1999

[54] ELECTRICAL PLUG CONNECTOR

[75] Inventors: Nigel Stewart Foster, Southhampton, England; Matthew Wilhite, Limerick, Ireland

[73] Assignee: Molex Incorporated, Lisle, Ill.

[21] Appl. No.: 864,631

[22] Filed: May 28, 1997

[51] Int. Cl.[6] ..... H01R 9/03

[52] U.S. Cl. ..... 439/580; 439/585; 439/877

[58] Field of Search ..... 439/580, 585, 439/582, 581, 877

[56] References Cited

U.S. PATENT DOCUMENTS

| | | | |
|---|---|---|---|
| 3,670,293 | 6/1972 | Garver | 439/585 |
| 4,199,214 | 4/1980 | Pearce, Jr. et al. . | |
| 4,678,261 | 7/1987 | Mitani et al. | 439/582 |
| 4,682,840 | 7/1987 | Lockard | 439/874 |
| 5,133,677 | 7/1992 | Sato et al. | 439/585 |
| 5,322,453 | 6/1994 | Resnick et al. | 439/581 |

OTHER PUBLICATIONS

Molex European drawing No. SK/96–0805–2.

*Primary Examiner*—Kheim Nguyen
*Assistant Examiner*—Eugene G. Byrd
*Attorney, Agent, or Firm*—Stephen Z. Weiss

[57] ABSTRACT

A cylindrical plug connector is provided for terminating an electrical cable which includes at least first and second inner conductors surrounded by an outer insulating jacket. A generally cylindrical dielectric housing mounts at least an outer cylindrical conductive contact and an inner conductive contact. The inner conductive contact is terminated to one of the first and second inner conductors of the cable. A terminal has a body portion in engagement with the outer cylindrical conductive contact. The terminal includes a first crimp arm projecting from the body portion for crimping termination with the other of the first and second inner conductors of the cable, and a second crimp arm projecting from the body portion for crimping onto the outer insulating jacket of the cable.

15 Claims, 4 Drawing Sheets

ELECTRICAL PLUG CONNECTOR

FIELD OF THE INVENTION

This invention generally relates to the art of electrical connectors and, particularly, to an electrical plug connector such as a DC plug connector for a multi-wire electrical cable.

BACKGROUND OF THE INVENTION

DC plug connectors are used to terminate multi-wire electrical cables, such as a 3-wire cable, with the plug connector being mateable into a cylindrical DC jack or socket. A typical DC plug connector includes a pair of outer, telescoped cylindrical contacts surrounding a center contact. The plural contacts conventionally are soldered to the three wires or conductors of the cable. Some form of strain relief means are provided between the connector and the cable. With the contacts being soldered to the conductors and the connector being additionally secured to the cable by the strain relief means, automated manufacture and/or assembly is difficult and expensive.

The present invention is directed to providing an extremely simple DC plug connector of the character described wherein all of the termination operations can be carried out by simple crimping processes.

SUMMARY OF THE INVENTION

An object, therefore, of the invention is to provide a new and improved cylindrical plug connector, such as a DC plug connector for a multi-wire electrical cable.

Generally, the cable includes at least first and second inner wires or conductors surrounded by an outer insulating jacket. The connector includes a generally cylindrical dielectric housing mounting at least an outer cylindrical conductive contact and an inner conductive contact. The inner conductive contact is terminated to one of the first and second inner conductors of the cable. A terminal is provided with a body portion in engagement with the outer cylindrical conductive contact. The terminal includes a first crimp arm projecting from the body portion for crimping termination with the other of the first and second inner conductors of the cable, and a second crimp arm projecting from the body portion for crimping onto the outer insulating jacket of the cable.

As disclosed herein, the body portion of the terminal is generally ring-shaped for embracing the outer cylindrical conductive contact. The second crimp arm of the terminal includes a U-shaped crimping portion for embracing the outer insulating jacket of the cable. The first crimp arm of the terminal includes a ring-shaped crimping portion for embracing the other of the first and second inner conductors of the cable. The inner conductive contact includes a ring-shaped crimping portion for embracing the one of the first and second inner conductors of the cable.

With a 3-conductor cable, the connector includes a second terminal having a crimp arm with a ring-shaped crimping portion for termination to the third conductor. Therefore, all of the contacts and/or terminals of the connector are terminated to the conductors of the cable, and the connector, itself, is secured to the cable by a strain relief means, with crimping-type assembly operations.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
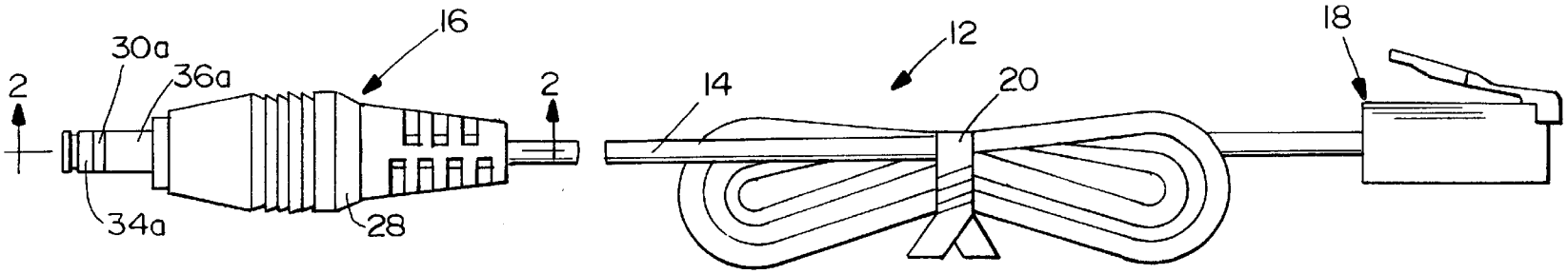
FIG. 1 is a side elevational view of a wiring harness having a DC plug connector at one end thereof.

Referring to the drawings in greater detail, and first to FIG. 1, a wiring harness, generally designated 12, is shown to include a multi-wire or multi-conductor electrical cable 14 having a cylindrical DC plug connector, generally designated 16, terminated to one end of the cable and a generally rectangular jack connector, generally designated 18, terminated to the opposite end of the cable. Typically, the cable is a 3-wire or 3-conductor cable. The harness is assembled and shipped with the cable folded and secured by a cable wrap 20. The invention is embodied in cylindrical DC plug connector 16.

Figure 2:
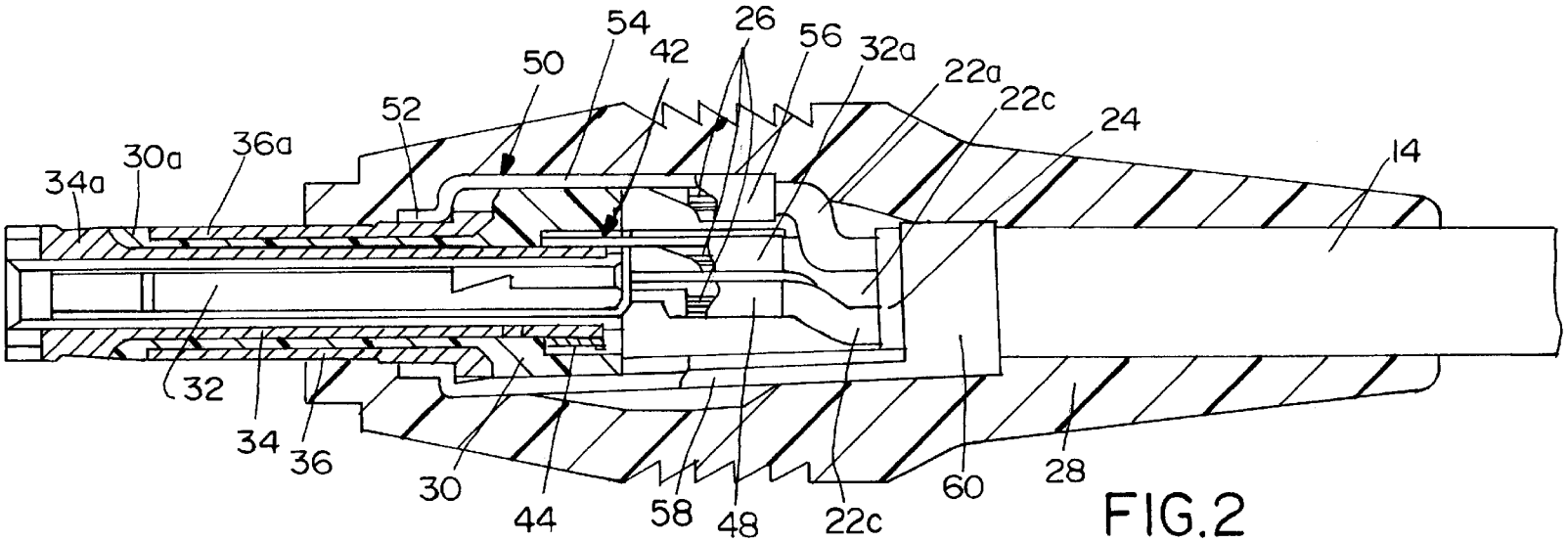
FIG. 2 is a vertical section, on an enlarged scale, taken through the plug connector generally along line 2—2 of FIG. 1.

Referring to FIG. 2 in conjunction with FIG. 1, cable 14 includes first, second and third inner conductors 22*a*, 22*b* and 22*c*, respectively, surrounding by an outer insulating jacket 24. Actually, the conductors, themselves, have inner conductive cores 26 surrounded by insulation whereby the contacts/terminals (described below) are terminated to the cores of the conductors. A plastic or elastomeric boot 26 is overmolded about the front end of cable 14 and the rear end of the connector, particularly about the termination and strain relief areas of the connector.

Figure 3:
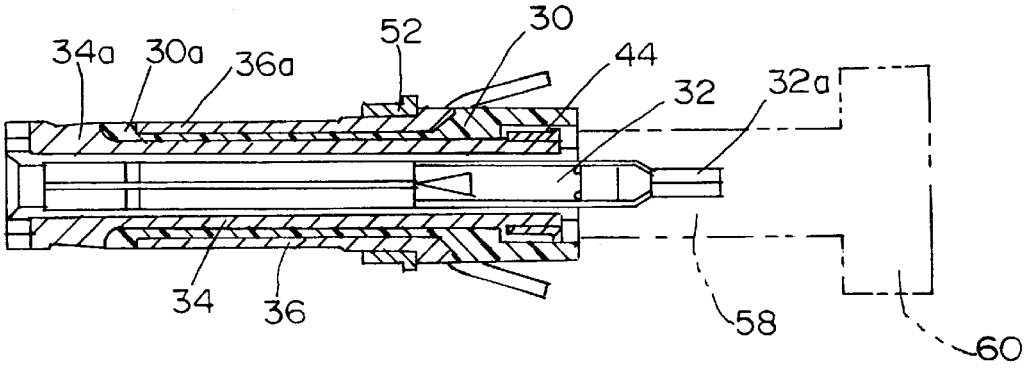
FIG. 3 is a horizontal section through the plug connector body, contacts and terminals, and with the cable and overmolded boot removed.
Figure 4:
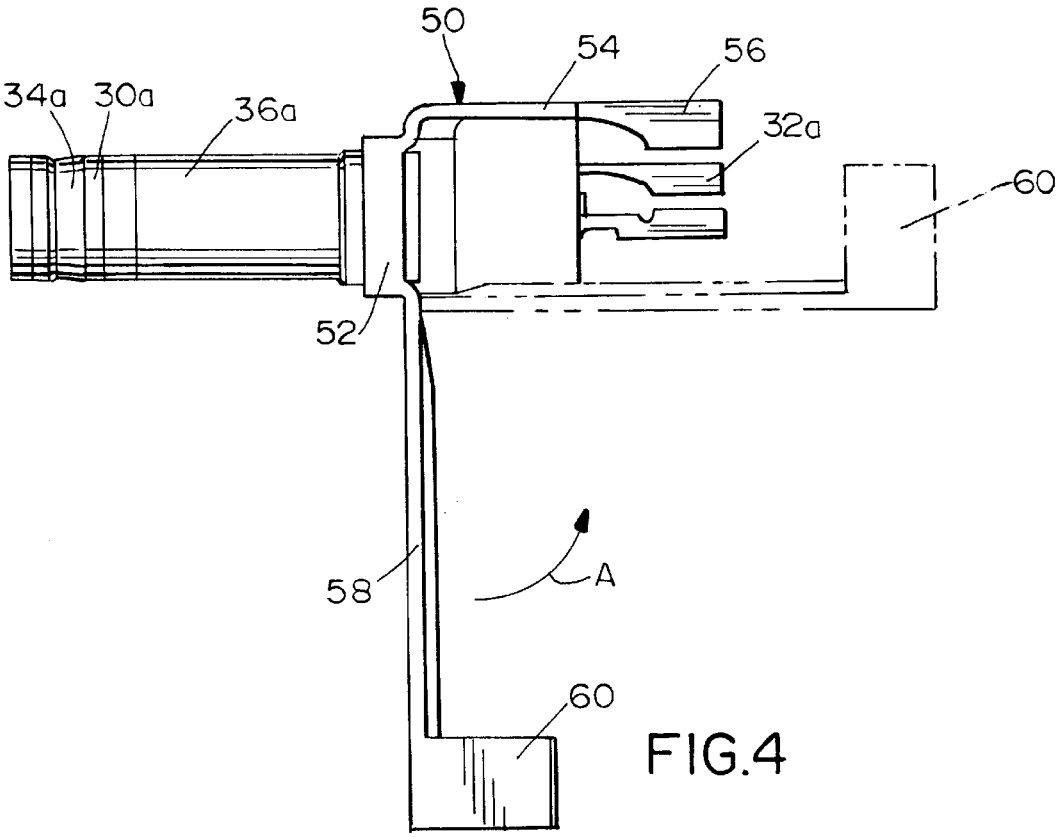
FIG. 4 is a side elevational view of the assembly of FIG. 3.

Referring to FIGS. 3 and 4 in conjunction with FIG. 2, connector 16 includes a generally cylindrical dielectric body 30 surrounding a center contact 32, a front contact 34 and a rear contact 36. Actually, front contact 34 is generally cylindrical and is an inner contact telescoped within rear contact 36 which can be considered an outer cylindrical contact. Inner cylindrical contact 34 is commonly termed the "front" contact because it has a front cylindrical contact portion 34*a* projecting forwardly of a cylindrical contact portion 36*a* of rear or outer contact 36. It can be seen in FIG. 2 that contact portions 34*a* and 36*a* of front and rear contacts 34 and 36, respectively, are exposed at the outside of the connector forwardly of overmolded boot 28. Whereas front and rear contacts 34 and 36, respectively, are separated by dielectric housing 30, forward contact portions 34*a* and 36*a* of the contacts are separated by a ring portion 30*a* of the dielectric housing. This also can be seen in FIG. 1.

Figure 6:
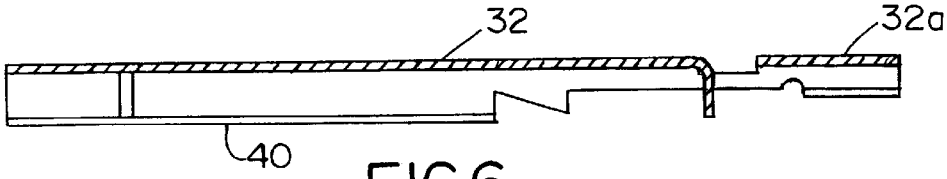
FIG. 6 is a section taken generally along line 6—6 of FIG. 5.
Figure 5:
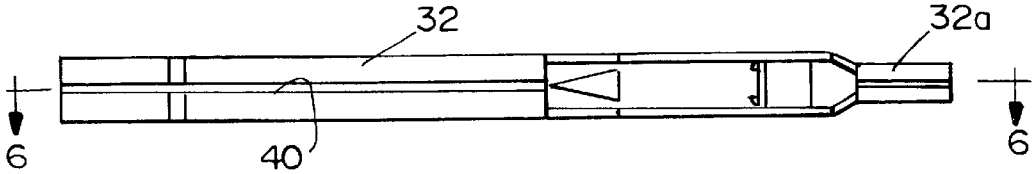
FIG. 5 is a bottom plan view of the center contact of the connector.

FIGS. 5 and 6 show center contact 32 to be generally cylindrical. The contact is a one-piece structure stamped and formed of conductive sheet metal material and is rolled into a cylindrical configuration defining a seam 40. The rear of the center contact has a cylindrical or ring-shaped crimping portion 32*a* for first supporting core 26 of first conductor 22*a* of cable 14 as seen in FIG. 2. The crimping portion is thereafter clamped onto the conductive core to terminate the first conductor of the cable.

Figure 7:
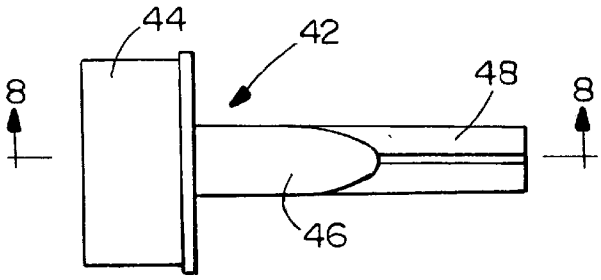
FIG. 7 is a bottom plan view of the inner terminal of the connector.
Figure 8:
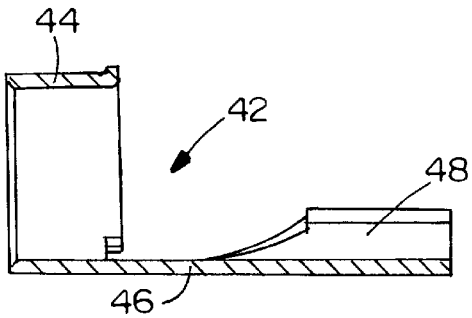
FIG. 8 is a section taken generally along line 8—8 of FIG. 7.

Referring to FIGS. 7 and 8 in conjunction with FIGS. 2–4, the plug connector includes an inner terminal, generally designated 42, which interconnects front or inner contact 34 with second conductor 22*c* of cable 14. The inner terminal is a one-piece structure stamped and formed of conductive sheet metal material. More particularly, inner terminal 42 includes a cylindrical body portion 44 which embraces and engages the rear of cylindrical contact 34 when inserted into the rear of the dielectric body 30. A crimp arm 46 projects rearwardly of body portion 44 and has a ring-shaped or cylindrical crimping portion 48 for first supporting and thereafter crimping onto conductive core 26 of second conductor 22*c* of cable 14 as seen in FIG. 2.

Figure 9:
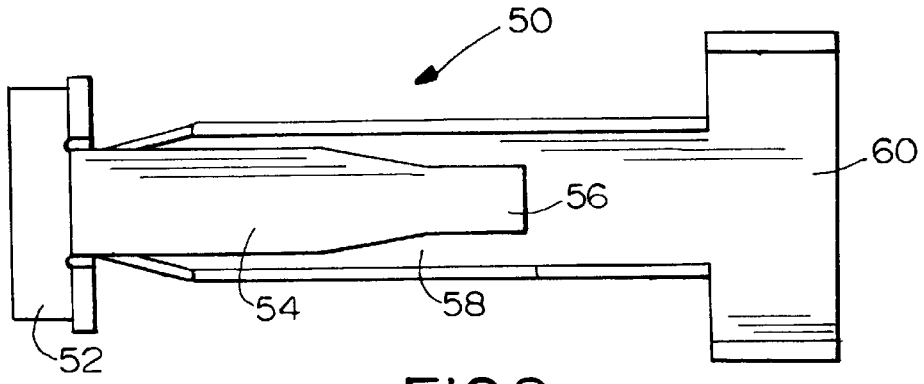
FIG. 9 is a bottom plan view of the outer terminal of the connector.
Figure 10:
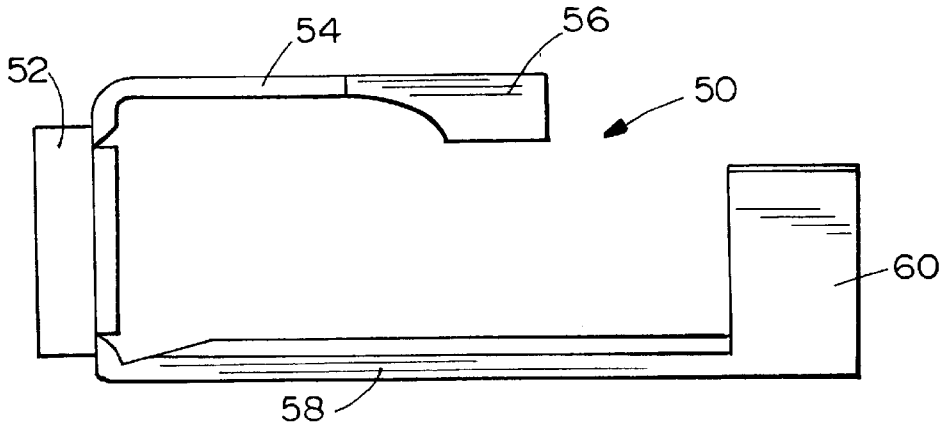
FIG. 10 is a side elevational view of the outer terminal of FIG. 9.

Referring to FIGS. 9 and 10 in conjunction with FIGS. 2–4, the connector includes an outer terminal, generally designated 50, for interconnecting rear or outer contact 36 with third conductor 22*b* of cable 14 as seen in FIG. 2. More particularly, outer terminal 50 has a cylindrical body portion 52 for embracing and engaging the rear 36*b* of cylindrical contact 36. Terminal 50 has a first crimp arm 54 projecting rearwardly of body portion 52 and having a ring-shaped or cylindrical crimping portion 56 for first supporting and thereafter crimping onto core 26 of third conductor 22*b* of cable 14 as best seen in FIG. 2. Terminal 50 also has a second crimp arm 58 projecting from body portion 52 and having a U-shaped crimping portion 60 for clamping onto the outer insulating jacket 24 of cable 14, again as best seen in FIG. 2.

Figure 11:
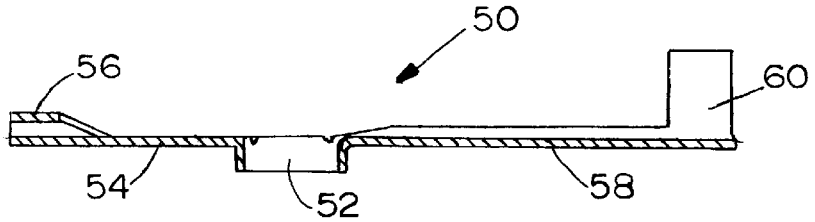
FIG. 11 is a section through the outer terminal of FIGS. 9 and 10 prior to the terminal being completely formed.

Outer terminal 50 is a one-piece structure stamped and formed of conductive sheet metal material. FIG. 11 shows the terminal stamped and partially formed such that crimp arms 54 and 58 project generally radially outwardly from cylindrical body portion 52 rather than rearwardly from the body portion in the final configuration of the terminal as shown in FIGS. 9 and 10. During assembly, first crimp arm 54 with its crimping portion 56 is bent rearwardly as shown in FIG. 4 so that the crimping portion is in alignment with crimping portion 32*a* of center contact 32 and crimping portion 48 of inner terminal 42. Cores 26 of conductors 22*a*, 22*b* and 22*c* of cable 14 then can be inserted into and supported by the cylindrical crimping portions 48, 32*a* and 56, and the crimping portions can be crimped simultaneously onto the cores of the conductors in a single automated termination operation. Still referring to FIG. 4, second crimp arm 58 of outer terminal 50 then can be bent or folded in the direction of arrow "A" from the full line position shown in FIG. 4 where the U-shaped crimping portion 60 is located away from the insulated jacket 24 to the phantom position which is the final position of the crimp arm such that crimping portion 60 can be crimped onto the outer insulating jacket 24 of cable 14 as seen in FIG. 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A cylindrical plug connector for an electrical cable which includes at least first and second inner conductors surrounded by an outer insulating jacket, comprising:

a generally cylindrical dielectric housing mounting at least an outer cylindrical conductive contact and an inner conductive contact;

said inner conductive contact being terminated to one of said first and second inner conductors of the cable; and aterminal having a body portion in engagement with said outer cylindrical conductive contact, a first crimp arm projecting from one side of the body portion for crimping termination with the other of said first and second inner conductors of the cable, and a second crimp arm projecting from a side of the body portion opposite said one side for crimping onto the outer insulating jacket of the cable.

2. The cylindrical plug connector of claim 1 wherein the body portion of said terminal is generally ring-shaped for embracing the outer cylindrical conductive contact.

3. The cylindrical plug connector of claim 2 wherein the second crimp arm of said terminal includes a U-shaped crimping portion for embracing the outer insulating jacket of the cable.

4. The cylindrical plug connector of claim 3 wherein the crimp arm being adapted to be bent from a position where the U-shaped crimping portion is located away from the outer insulating jacket of the cable to a position where the U-shaped crimping portion is located in a position to embrace the outer insulating jacket.

5. The cylindrical plug connector of claim 3 wherein the first crimp arm of said terminal includes a ring-shaped crimping portion for embracing the other of said first and second inner conductors of the cable.

6. The cylindrical plug connector of claim 5 wherein said inner conductive contact includes a ring-shaped crimping portion for embracing said one of the first and second inner conductors of the cable.

7. The cylindrical plug connector of claim 1 wherein said inner conductive contact includes a crimping portion for termination directly to said one of the first and second inner conductors of the cable.

8. The cylindrical plug connector of claim 1, including a second terminal having a body portion in engagement with the inner conductive contact and a crimp arm projecting from the body portion for crimping termination with said one of the first and second inner conductors of the cable.

9. A cylindrical plug connector for an electrical cable which includes at least first, second and third inner conductors surrounded by an outer insulating jacket, comprising:

a generally cylindrical dielectric housing mounting an outer cylindrical conductive contact, an inner conductive contact, and a center conductive contact;

said center conductive contact being terminated to one of the inner conductors of the cable;

an inner terminal having a body portion in engagement with said inner cylindrical conductive contact and a crimp arm projecting from the body portion for crimping termination with a second one of the inner conductors of the cable; and an outer terminal having a body portion in engagement with said outer cylindrical conductive contact, a first crimp arm projecting from the body portion for crimping termination with a third of the inner conductors of the cable, and a second crimp arm projecting from the body portion for crimping onto the outer insulating jacket of the cable.

10. The cylindrical plug connector of claim 9 wherein the body portions of said inner and outer terminals are generally ring-shaped for embracing the inner and outer cylindrical conductive contacts.

11. The cylindrical plug connector of claim 10 wherein the second crimp arm of said outer terminal includes a U-shaped crimping portion for embracing the outer insulating jacket of the cable.

12. The cylindrical plug connector of claim 11 wherein the second crimp arm being adapted to be bent from a position where the U-shaped crimping portion is located away from the outer insulating jacket of the cable to a position where the U-shaped crimping portion is located in a position to embrace the outer insulating jacket.

13. The cylindrical plug connector of claim 11 wherein the first crimp arm of said outer terminal and the crimp arm of said inner terminal include ring-shaped crimping portions for embracing the respective inner conductors of the cable.

14. The cylindrical plug connector of claim 13 wherein said center conductive contact includes a ring-shaped crimping portion for embracing said one of the inner conductors of the cable.

15. A cylindrical plug connector for an electrical cable which includes at least first, second and third inner conductors surrounded by an outer insulating jacket, comprising:

a generally cylindrical dielectric housing mounting an outer cylindrical conductive contact, an inner cylindrical conductive contact, and a center conductive contact;

said center conductive contact including a crimping portion for crimping termination directly to one of the inner conductors of the cable;

an outer terminal having a body portion in engagement with said outer cylindrical conductive contact and a crimping portion for crimping termination directly to a second of the inner conductors of the cable; and an inner terminal having a body portion in engagement with said inner cylindrical conductive contact and a crimping portion for crimping termination directly to a third of the inner conductors of the cable, whereby the inner cylindrical conductive contact and the inner and outer terminals all can be simultaneously terminated to the three inner conductors of the cable by a single crimping operation.

* * * * *